US012704342B1

(12) United States Patent
DeVita

(10) Patent No.: US 12,704,342 B1
(45) Date of Patent: Aug. 11, 2026

(54) ELECTRONICALLY CONTROLLED RECOIL POSITIONING (ECRP) SYSTEM FOR FIREARMS

(71) Applicant: John Alexander DeVita, Galveston, TX (US)

(72) Inventor: John Alexander DeVita, Galveston, TX (US)

( * ) Notice: Subject to any disclaimer, the term of this patent is extended or adjusted under 35 U.S.C. 154(b) by 0 days.

(21) Appl. No.: 19/364,230

(22) Filed: Oct. 21, 2025

(51) Int. Cl.
*F41A 21/38* (2006.01)
*F41A 21/36* (2006.01)

(52) U.S. Cl.
CPC ..... *F41A 21/36* (2013.01); *F41A 21/38* (2013.01)

(58) Field of Classification Search
CPC ..... F41A 21/36; F41A 21/32; F41A 21/325; F41A 21/34; F41A 21/38
USPC ..... 89/14.3
See application file for complete search history.

(56) References Cited

U.S. PATENT DOCUMENTS

| | | | | |
|---|---|---|---|---|
| 4,457,206 | A * | 7/1984 | Toulios | F41G 5/08 89/14.05 |
| 5,631,437 | A * | 5/1997 | LaVigna | F41A 27/30 89/14.05 |
| 5,652,406 | A * | 7/1997 | Phan | F41A 21/36 89/14.3 |
| 6,752,062 | B2 | 6/2004 | Vias | |
| 7,032,339 | B1 | 4/2006 | Bounds | |
| 8,186,261 | B2 | 5/2012 | McNeill et al. | |
| 8,505,680 | B2 | 8/2013 | Dueck | |
| 8,695,474 | B2 | 4/2014 | Overbeek-Bloem et al. | |
| 9,212,861 | B2 | 12/2015 | Panak | |
| 9,341,426 | B1 | 5/2016 | Larson, Jr. | |
| 9,395,155 | B1 | 7/2016 | Bockmon | |
| 9,709,355 | B2 | 7/2017 | Joplin et al. | |
| 9,995,551 | B2 * | 6/2018 | Whitfield, Jr. | F41A 5/26 |
| 11,041,688 | B2 | 6/2021 | Joplin | |
| 11,333,459 | B2 | 5/2022 | Hipp | |
| 11,353,278 | B2 * | 6/2022 | Williams | F41A 21/38 |
| 12,007,188 | B2 | 6/2024 | Herskowitz et al. | |
| 2009/0133570 | A1 * | 5/2009 | Pfersmann | F41A 25/22 89/14.3 |
| 2015/0308771 | A1 * | 10/2015 | Marr | F41G 3/12 42/84 |
| 2019/0353447 | A1 | 11/2019 | Palenik, II | |
| 2021/0310761 | A1 | 10/2021 | Sogaard | |

FOREIGN PATENT DOCUMENTS

| | | | |
|---|---|---|---|
| EP | 3788316 | 1/2023 | |
| GB | 479107 | 4/1936 | |
| WO | 2019213149 | 11/2019 | |
| WO | WO-2019213149 A1 * | 11/2019 | F41A 27/30 |

* cited by examiner

*Primary Examiner* — John Cooper
(74) *Attorney, Agent, or Firm* — The Buche Law Firm, P.C.; Bryce A. Johnson; John K. Buche

(57) ABSTRACT

An Electronic Controlled Recoil Position (ECRP) unit is muzzle-mounted on a firearm and is designed for nearly real-time correction of the firearm's recoil. This correction can maintain a shooters aim on target or else nearly remove recoil for easier control of the firearm during full or semi-automatic fire. The ECRP unit is primarily designed as a cylindrical body that attaches to the muzzle of a firearm barrel via threaded or snap-on connection. The unit features an internal bore aligned with the barrel to allow projectiles to pass through unimpeded.

18 Claims, 3 Drawing Sheets

ELECTRONICALLY CONTROLLED RECOIL POSITIONING (ECRP) SYSTEM FOR FIREARMS

CROSS-REFERENCE TO RELATED APPLICATIONS

See Application Data Sheet (ADS).

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter relates generally to firearms technology, and more particularly to an electronically controlled recoil management system.

Listing of the Prior Art

The following references might be to be related to the disclosed subject matter:

U.S. Pat. No. 9,212,861 by Panak (issued Dec. 15, 2015) discloses a "feedback-controlled re-targeting apparatus for automatic firearm."

US20150308771A1 by Marr (issued Oct. 29, 2015) discloses a "system for acquiring targets and automatically correcting the firing of small arms."

U.S. Ser. No. 12/007,188 by Herskowitz et al. (issued Jun. 11, 2024) discloses a "firearm with automatic target acquiring and shooting."

U.S. Pat. No. 5,631,437 by LaVigna et al. (issued May 20, 1997) discloses a "gun muzzle control system using barrel mounted actuator assembly." The abstract reads:

WO2019213149A1 by Williams (published Nov. 7, 2019) discloses "systems and method for firearm aim-stabilization."

This technology is also described in EP3788316B1 by Williams (published Jan. 3, 2023).

U.S. Pat. No. 9,395,155 by Bockmon (issued Jul. 19, 2016) discloses "active stabilization targeting correction for hand held firearms."

U.S. Ser. No. 11/041,688 by Joplin (issued Jun. 22, 2021) discloses a "tunable muzzle brake for a firearm."

U.S. Pat. No. 9,995,551 by Whitfield, Jr. (issued Jun. 12, 2018) discloses a "universal custom recoil solution system."

GB479107 by Czarnecki (published Apr. 28, 1936) discloses an "improved recoil damping device for firearms."

U.S. Pat. No. 8,695,474 by Overbeek-Bloem et al. (issued Apr. 15, 2014) discloses a "muzzle device and method of tuning thereof."

U.S. Pat. No. 9,709,355 by Joplin et al. (issued Jul. 18, 2017) discloses a "recoil compensator for firearm."

U.S. Ser. No. 11/333,459 by Hipp (issued May 17, 2022) discloses an "adjustable tuning device."

US20210310761A1 by Sogaard (published Oct. 7, 2021) discloses a "muzzle brake and muzzle brake system."

U.S. Pat. No. 8,186,261 by McNeill et al. (issued May 29, 2012) discloses an "adjustable muzzle brake."

U.S. Pat. No. 9,341,426 by Larson, Jr. (issued May 17, 2016) discloses a "muzzle brake for firearm."

U.S. Pat. No. 8,505,680 by Dueck (issued Aug. 13, 2013) discloses a "fire arm attachment."

U.S. Pat. No. 7,032,339 by Bounds (issued Apr. 25, 2006) discloses a "lateral projection muzzle brake."

US6752062 by Vias (issued Jun. 22, 2004) discloses a "muzzle brake."

US20190353447 by Palenik, II (published Nov. 21, 2019) discloses "systems, methods, and apparatus for recoil mitigation."

See the Information Disclosure Statements (IDS) of record.

Background of the Invention

Firearms, particularly rifles and automatic weapons, present shooters with the challenge of managing recoil forces that affect accuracy. After firearm discharge, the explosive expansion of gases propels the projectile forward while simultaneously pushing the firearm backward in an opposite direction of the projectile. This recoil force typically generates a complex motion combining linear backward movement with rotational components that cause the muzzle to rise or move laterally (collectively "muzzle rise"). For precise or competitive shooting and military operations, these recoil-induced movements (recoil) significantly impair the shooter's ability to maintain accuracy or an on-target position, especially during rapid or automatic fire sequences.

Conventional approaches to recoil management primarily focus on passive mechanical solutions. Traditional muzzle brakes counteract muzzle rise by redirecting propellant gases from firearm discharge through fixed, non-adjustable ports. These static devices offer the same recoil compensation regardless of shooting conditions, ammunition type, or the individual shooter's technique. Similarly, buffer systems, recoil pads, and specialized stocks can absorb some recoil energy but cannot adapt to changing conditions or shooting patterns. These passive systems function identically under all circumstances, making them incapable of responding to variable or dynamic shooting scenarios where environmental factors, shooter fatigue, or varying ammunition loads dramatically alter recoil characteristics.

The technical limitations of static recoil management systems become particularly evident when examining their inability to process real-time feedback. A standard muzzle brake optimized for one set of conditions (e.g., specific ammunition type or shooting position) may prove ineffective or even counterproductive under different circumstances. Furthermore, these passive systems cannot build historical data profiles to anticipate and compensate for individual shooter tendencies that develop over time. This lack of satisfactory recoil management solutions has driven research toward adaptive, electronically controlled recoil management systems.

Recent advances have attempted to address these limitations. U.S. Pat. No. 9,212,861 to Panak represents a significant step forward, disclosing a "Feedback-Controlled Re-Targeting Apparatus for Automatic Firearm." Panak's invention utilizes sensors to capture an initial line-of-sight to a target and measure deviations during firing. The system includes controllable ports that vary the discharge of combustion gases to generate corrective forces on the barrel. While this approach demonstrates the potential of active recoil management, it suffers from several technical limitations.

First, Panak's system employs a simple feedback control methodology that responds only to instantaneous deviations from an initial line-of-sight, without the capability to learn from historical shooting patterns or adapt to individual shooter characteristics over time. The system lacks machine learning algorithms that could analyze shooting patterns and environmental conditions to make predictive adjustments rather than purely reactive ones. Second, Panak's port configuration provides limited control granularity. More specifically, the system does not incorporate strategically arranged, variably-sized vents positioned to provide precisely calibrated directional control over different magnitudes of recoil compensation. This constraint limits the system's ability to make fine-tuned adjustments for optimal accuracy under variable shooting conditions. Third, Panak's approach focuses primarily on maintaining target alignment for sequential shots rather than comprehensively managing recoil forces across multiple shooting scenarios. The system cannot be configured for different operational modes, such as prioritizing shooter comfort during extended firing sessions or maximizing control during rapid-fire sequences. Fourth, Panak's implementation relies on fiber optic gyros for angular measurements but lacks integration with modern optical systems that could provide critical shot placement data. The system cannot connect with barrel-mounted cameras, electronic scopes, or other digital peripherals that could enhance its effectiveness through expanded data collection and analysis capabilities.

The shooting community has increasingly recognized the need for a more intelligent, adaptive recoil management system that can analyze individual shooting patterns and automatically adjust to optimize accuracy under varying conditions. Modern competitive shooters, military personnel, and law enforcement officers require a system that not only compensates for recoil but actively learns from shot placement data to continuously improve performance across different firearms, ammunition types, and environmental conditions.

Current technological capabilities in miniaturized sensors, high-speed actuators, artificial intelligence, and materials science now make it possible to develop a significantly more advanced electronically controlled recoil management system. Such a system could utilize artificial intelligence to analyze shooting patterns, integrate with modern optics for shot placement analysis, and precisely control recoil forces through selectively actuated venting mechanisms with variable aperture sizes and configurations. The present invention addresses these technical needs through an Electronically Controlled Recoil Positioning (ECRP) system that represents a significant advancement beyond both the static compensation methods of traditional muzzle brakes and the limited adaptive capabilities of prior art systems like Panak's.

SUMMARY OF THE INVENTION

The disclosed subject matter provides an Electronically Controlled Recoil Positioning (ECRP) system for firearms that significantly advances the state of the art in dynamic recoil management. In its preferred embodiment, the ECRP unit is muzzle-mounted on a firearm and engineered for near real-time correction of recoil forces through an artificial intelligence-driven system that continuously analyzes shooting patterns and adaptively controls selective gas venting mechanisms.

The ECRP unit comprises a cylindrical body constructed from lightweight, high-strength materials such as aircraft-grade aluminum alloy or titanium alloy capable of withstanding the extreme temperatures and pressures associated with firearm discharge. The unit features a central bore aligned precisely with the barrel to allow projectiles to pass through unimpeded, while surrounding this bore is an expansion chamber that temporarily captures combustion gases following discharge. The body connects to the firearm barrel via precision-machined threads or a quick-attachment mounting system compatible with standard firearm specifications.

A distinguishing feature of the ECRP system is its advanced artificial intelligence subsystem that utilizes machine learning algorithms to process data from multiple sources, including shot placement analysis via optical systems (barrel-mounted camera or scope camera) and a comprehensive sensor array. Unlike prior art systems that merely react to instantaneous deviations from an initial line-of-sight, the ECRP's AI develops individualized shooter profiles that anticipate recoil patterns based on historical performance data, environmental conditions, ammunition characteristics, and shooter tendencies. This predictive capability enables the system to make proactive adjustments before recoil forces fully develop, resulting in accuracy enhancement during rapid fire sequences.

The strategic arrangement of variably-sized vents represents another significant advancement over existing recoil management systems. The ECRP unit incorporates multiple vent apertures positioned at precise coordinates around the cylindrical body, specifically including large vents, medium vents, and small vents. These vents are arranged in groups of three (one of each size) on the top, bottom, left side, and right side of the unit, resulting in twelve independently controlled venting mechanisms. Each vent incorporates a precision actuation system that can be configured in multiple operational modes, including axially sliding covers, hinged covers, or circumferentially sliding covers, each driven by miniaturized high-speed actuators capable of response times that are fast enough to account for the delay between a trigger-pull or auto-fire trigger and projectile emission from the firearm.

The ECRP unit further incorporates sophisticated multi-protocol communication capabilities that enable seamless integration with the broader firearm ecosystem. The system can connect to barrel-mounted cameras, scope-mounted cameras, ballistic calculators, and other compatible accessories either via direct cable connection, wireless transmission (including Bluetooth or Bluetooth 5.0 Low Energy), or other practical means. This connectivity facilitates real-time data exchange between the ECRP unit and other firearm subsystems, enabling comprehensive performance optimization beyond simple recoil management.

In operation, the ECRP system functions through a coordinated sequence: (1) establishing a baseline position through sensor data before firing; (2) detecting discharge initiation through pressure and accelerometer sensors; (3) temporarily capturing propellant gases in the expansion chamber; (4) analyzing recoil forces through the sensor array; and (5) selectively actuating specific vents to counteract detected recoil forces. The system determines which vents to open based on both the direction and magnitude of detected recoil, with larger adjustments utilizing the large vents or multiple vents in concert, while finer adjustments employ the smaller vents.

A distinctive operational capability of the ECRP system is its configurable "Near-Zero Recoil" mode optimized for automatic or select-fire weapons. In this mode, rather than focusing exclusively on precise target acquisition, the system prioritizes minimizing perceived recoil by dynamically counteracting muzzle movement during rapid fire sequences, significantly improving controllability and maintaining a stable sight picture throughout extended firing sessions.

The ECRP system overcomes limitations of prior art approaches by combining sophisticated artificial intelligence, precisely controlled variable-aperture venting mechanisms, and comprehensive integration with modern firearm systems to deliver adaptive recoil management that continuously improves through machine learning. This represents a significant advancement beyond both static muzzle brakes and the feedback-controlled systems disclosed in prior art such as Panak (U.S. Pat. No. 9,212,861), which lacks the sophisticated learning capabilities, variable vent configurations, and comprehensive ecosystem integration of the present invention.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

In the figures, the following components of the preferred embodiment are shown in connection with the corresponding reference numeral identified below.

1000 ECRP unit
1100 large vent
1200 medium vent
1300 small vent
2000 firearm barrel It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is an ECRP unit and related systems. In use, the ECRP unit is muzzle-mounted on the firearm and is designed for nearly real-time correction of the firearm's recoil. In one embodiment, the ECRP unit 1000 incorporates a sophisticated electronic control system to regulate the operation of the vents with precision timing and adaptive learning capabilities. This system includes multiple integrated components working in concert to deliver superior recoil management performance, as illustrated in FIGS. 1-5C.

Figure 1:
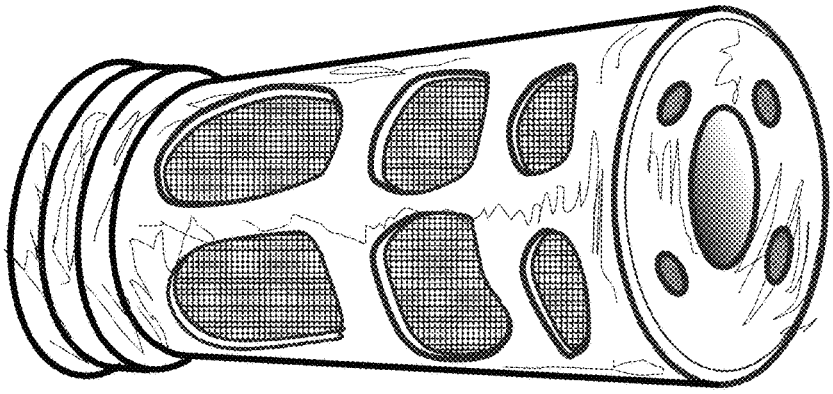
FIG. 1 is a perspective view of the preferred embodiment of the ECRP unit 1000 showing its large vents 1100, medium vents 1200, and small vents 1300 in a closed state.
Figure 4A:
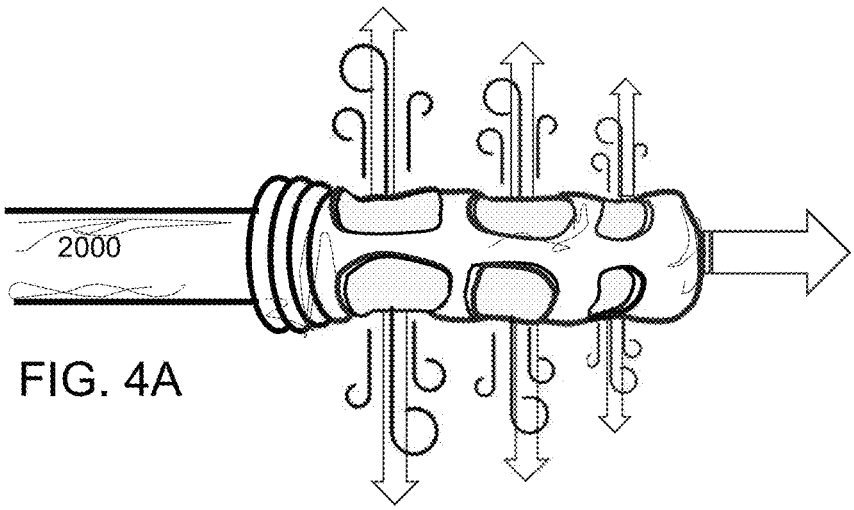
FIG. 4A is a contextual view of the ECRP unit 1000 installed on the barrel 2000 of a firearm and where the large, medium, or small vents 1100, 1200, 1300 are in a slid-open state.
Figure 4B:
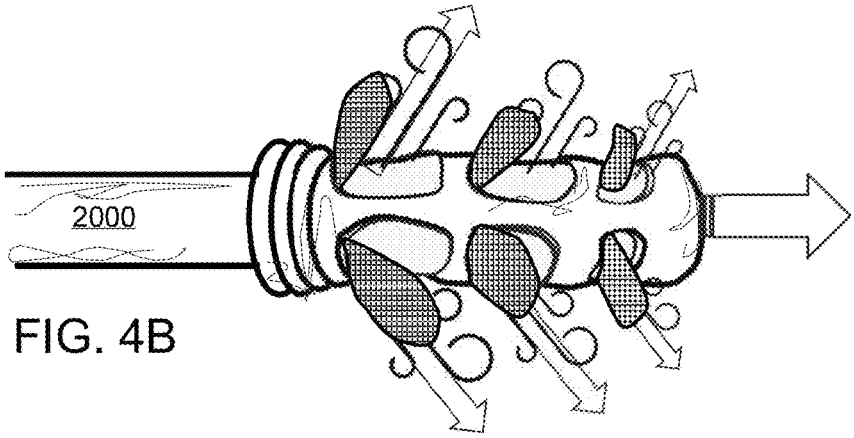
FIG. 4B is a contextual view of the ECRP unit 1000 installed on the barrel 2000 of a firearm and where the large, medium, or small vents 1100, 1200, 1300 are in a hinged-open state.

Referring now to FIG. 1, a perspective view of an ECRP unit 1000 is shown. The ECRP unit 1000 comprises a generally cylindrical body configured for attachment to the muzzle of a firearm barrel 2000 (as shown in FIGS. 4A and 4B). The primary purpose of the ECRP unit 1000 is to provide dynamic, adaptive control of recoil forces and muzzle positioning during firearm discharge through the selective opening and closing of variably-sized vents arranged strategically around the device. As illustrated in FIG. 1, the ECRP unit 1000 includes large vents 1100, medium vents 1200, and small vents 1300 positioned around the cylindrical body, all shown in their closed state.

Figure 2:
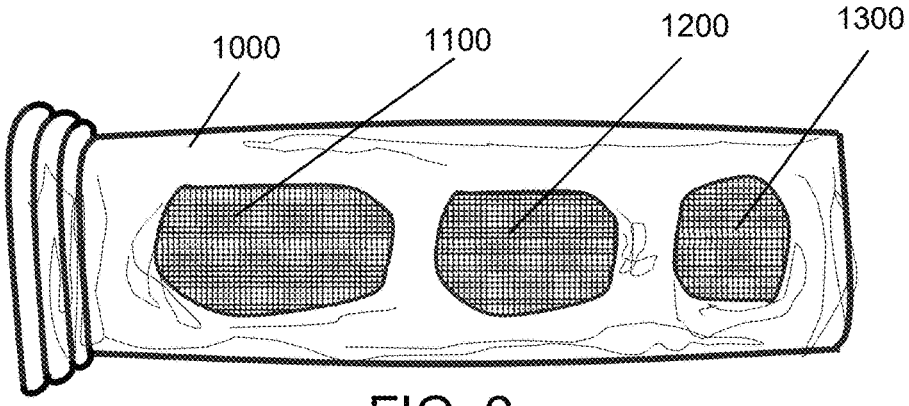
FIG. 2 is a top, bottom, or side view of the ECRP unit 1000 showing the large, medium, and small vents 1100, 1200, 1300 in a closed state.

As can be seen in FIG. 2, which provides a top, bottom, or side view of the ECRP unit 1000, the unit features a specific arrangement of the variably-sized vents. In the preferred embodiment, the top, bottom, and both sides of the ECRP unit 1000 each feature three vents of varying sizes: a large vent 1100, a medium vent 1200, and a small vent 1300. This arrangement results in twelve total vents positioned symmetrically around the ECRP unit 1000, with each directional face (top, bottom, left side, right side) having one of each vent size.

More specifically, the exterior surface of the ECRP unit 1000 incorporates a strategic arrangement of variably-sized vents positioned at specific coordinates around the cylindrical body. Specifically, the unit features: large vents 1100; medium vents 1200; small vents 1300. Preferably, these vents are arranged in groups of three (one of each size) on the top, bottom, left side, and right side of the unit, resulting in a total of twelve controllable vents. Each vent incorporates a precision actuation mechanism that enables independent operation, allowing for customized gas flow patterns based on real-time shooting conditions As shown in FIGS. 1 and 2, the ECRP unit is tubular. The interior of the ECRP unit 1000 includes a central bore that aligns with the firearm barrel 2000 to allow projectiles to pass through unimpeded. Surrounding this bore is an expansion chamber that temporarily captures combustion gases following discharge, before these gases are selectively vented through the controllable large vents 1100, medium vents 1200, and small vents 1300. Suitably, the ECRP unit 1000 may be constructed from high-strength, lightweight materials capable of withstanding the extreme temperatures and pressures associated with firearm discharge. In the preferred embodiment, the body is precision-machined from e.g., high-grade aluminum alloy or titanium alloy (including military or firearm grade materials) with critical internal surfaces receiving heat-resistant coatings to extend operational lifespan.

Figure 3A:
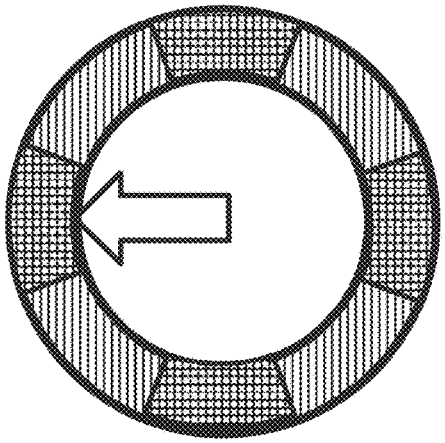
FIG. 3A is a cross section view of the ECRP unit 1000 taken across any of the large, medium, or small vents 1100, 1200, 1300 in a closed state.
Figure 3B:
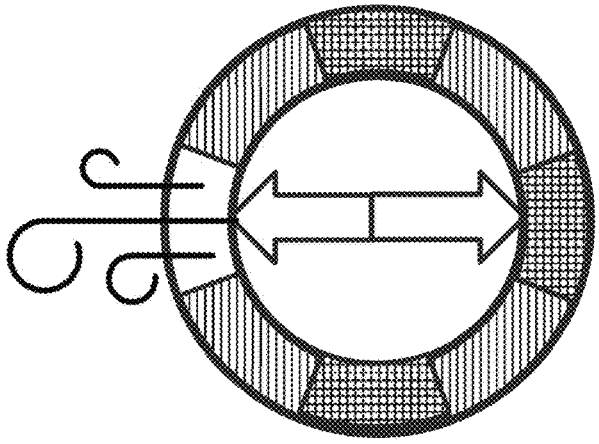
FIG. 3B is a cross section view of the ECRP unit 1000 taken across any of the large, medium, or small vents 1100, 1200, 1300 where one of the vents 1100, 1200, 1300 is in an open state.
Figure 5A:
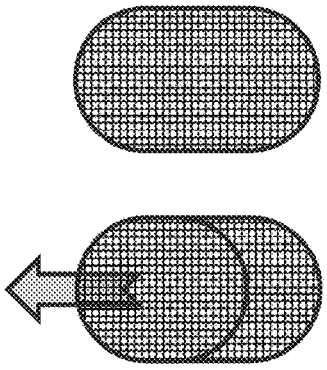
FIG. 5A is a contextual view of the any one of the large, medium, or small vents 1100, in an axially slid-open state.
Figure 5B:
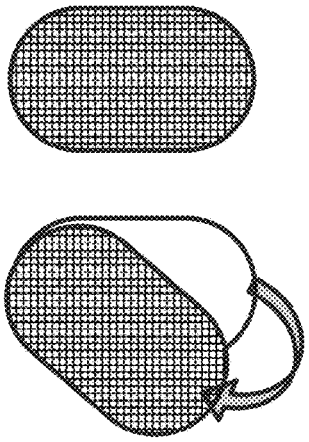
FIG. 5B is a contextual view of the any one of the large, medium, or small vents 1100, in an hinged-open state.
Figure 5C:
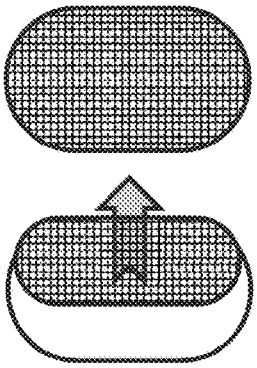
FIG. 5C is a contextual view of the any one of the large, medium, or small vents 1100, in a circumferentially slid-open state; and, FIG. 6 shows an A-10 aircraft with a ECRP unit installed on the GAU-8 Avenger cannon mounted on the nose.

Referring to FIGS. 3A and 3B, cross-sectional views of the ECRP unit 1000 are shown across any of the large vents 1100, medium vents 1200, or small vents 1300. FIG. 3A illustrates the vent in a closed state, while FIG. 3B shows one of the vents in an open state. Each vent incorporates a precision actuation mechanism that enables independent operation, allowing for customized gas flow patterns based on real-time shooting conditions. The ECRP unit 1000 employs multiple possible vent actuation configurations as illustrated in FIGS. 5A, 5B, and 5C. FIG. 5A depicts a vent in an axially slid-open state, where the vent cover retracts linearly along the barrel axis. FIG. 5B shows a vent in a hinged-open state, where the cover swings open radially from the barrel. FIG. 5C illustrates a vent in a circumferentially slid-open state, where the cover rotates around the barrel axis. These actuation mechanisms employ miniaturized high-speed servo motors or piezoelectric actuators capable of precise positioning with response times fast enough to compensate auto-fire trigger or trigger-pull and projectile emission. The actuators connect to a central control board housed within a sealed compartment of the ECRP unit 1000.

As shown in FIGS. 4A and 4B, the ECRP unit 1000 is designed to be installed directly onto the barrel 2000 of a firearm. The interior surface of the rear portion of the ECRP unit 1000 features threading that corresponds to standard muzzle threads found on most modern firearms, allowing for secure attachment. FIG. 4A illustrates the ECRP unit 1000 installed on a firearm barrel 2000 with vents in a slid-open state, while FIG. 4B shows the ECRP unit 1000 with vents in a hinged-open state. The ECRP unit 1000 is positioned such that when a round is fired, the propellant gases that follow the projectile through the barrel 2000 enter the expansion chamber of the ECRP unit 1000. The projectile continues unimpeded through the central bore of the ECRP unit 1000, while the combustion gases are temporarily captured before being selectively vented through the controllable ports.

FIGS. 5A through 5C illustrate the possible actuation mechanisms for the vents. Suitably, the vents employ one of several possible configurations. One configuration involves axially sliding covers that retract linearly along the barrel axis (as shown in FIG. 5A). Another configuration involves hinged covers that swing open radially from the barrel (as shown in FIG. 5B). A third configuration may involve circumferentially sliding covers that rotate around the barrel axis (as shown in FIG. 5C). Each vent actuation system incorporates for example miniaturized high-speed servo motors or piezoelectric actuators capable of precise positioning with fire-arm appropriate response times. These actuators connect to a central control board housed within a sealed compartment of the ECRP unit (as discussed in further detail below).

In one version, the ECRP unit 1000 incorporates an electronic control system to regulate the operation of the vents. This system includes multiple integrated components. Components include: a Central Processing Unit (CPU); a sensor array; a power system, an AI system; a communication module; and other accessories.

The CPU may suitably be a miniaturized, ruggedized microprocessor capable of performing complex calculations in real-time while withstanding recoil forces. Suitably, the CPU may be specifically designed to withstand the extreme forces associated with firearm discharge while maintaining computational integrity. This processor operates at minimum clock speeds that are appropriate for the firearm context and may have hardened circuitry to resist shock forces. This CPU may be housed within the ECRP unit itself or in a separate control module attached elsewhere on the firearm. Specifically, the CPU may be housed within a sealed compartment of the ECRP unit 1000 or optionally in a separate control module mounted elsewhere on the firearm for weight distribution optimization The sensor array could include multiple high-precision sensors monitor critical parameters: Gyroscopic sensors to detect angular movement in all three axes; accelerometers to measure linear forces and acceleration; pressure sensors within the expansion chamber to monitor gas pressure during discharge; thermal sensors to account for temperature variations affecting performance. The comprehensive sensor array includes multiple high-precision instruments: tri-axial gyroscopic sensors with minimum sensitivity appropriate for firearm contexts to detect angular movement in pitch, yaw, and roll; accelerometers measuring linear forces up to fire-arm appropriate resolution; multiple pressure sensors distributed within the expansion chamber capable of monitoring gas pressure variations during discharge with sampling rates appropriate for discharge of a firearm; and thermal sensors that provide temperature compensation for both environmental conditions and heat buildup during sustained firearm firing.

The unit is powered by a rechargeable lithium polymer battery pack providing a timeframe of continuous operation. The battery compartment should be designed for quick-swap capability, allowing for rapid replacement in field conditions. The battery compartment incorporates quick-disconnect terminals and a sealed housing, allowing for rapid replacement under field conditions without exposing internal electronics to environmental contaminants. An intelligent power management system could be used to extend operational duration when battery levels approach depletion threshold.

The AI system might be consider a core of the ECRP unit's adaptive capabilities is its AI system, which continuously learns from shooting patterns and makes predictive adjustments based on historical data and current conditions. Suitably, the communication module may suitably be multi-protocol communication capabilities that enable connectivity with various firearm ecosystem peripherals, including barrel-mounted cameras or scope cameras for shot placement analysis, electronic trigger systems, mobile devices (like smartphones or laptops) for configuration and data analysis, and other compatible accessories. A multi-protocol communication system enables connectivity, in some embodiments, via: Bluetooth or Bluetooth 5.0 Low Energy for wireless connection to scopes, smartphones, or other devices; hardwired connection ports (e.g., USB-C or proprietary connector) for direct interface with firearm optics or external processing units; or optional encrypted RF transmission capability for tactical applications where secure communication is required. Unlike prior art systems such as Panak's feedback control approach (U.S. Pat. No. 9,212,861) that simply reacts to instantaneous deviations, the ECRP's AI constructs comprehensive shooter profiles through unsupervised learning algorithms that identify distinctive patterns in recoil management requirements. These profiles account for individual shooter biomechanics, grip consistency, stance variations, and firearm-specific characteristics, enabling the system to make predictive adjustments rather than purely reactive ones.

Another optimal feature of the ECRP unit 1000 may be its ability to learn and adapt to the specific characteristics of the firearm and the shooting patterns of the individual user. The AI system continuously analyzes shot placement data (gathered via barrel-mounted camera or scope camera) and correlates this information with the recoil patterns detected by the onboard sensors. Over time, the system may be direct to build a comprehensive profile of how the firearm behaves under various conditions and how the shooter interacts with the weapon. This learning process enables the ECRP unit 1000 to make increasingly precise adjustments to counteract recoil forces and improve accuracy.

In other words, the ECRP incorporates an AI system that serves as the core of its adaptive capabilities. This system may be implemented either directly within the ECRP unit's CPU or off-loaded to a connected device such as a scope with integrated processing capabilities. The AI system comprises several modules. The modules include: a machine learning algorithm to define a neural network-based system that progressively learns from shooting patterns, analyzing shot placement relative to target, recoil characteristics specific to the firearm, environmental factors (wind, temperature, humidity), and shooter-specific tendencies and habits; a real-time analysis engine to process data from the sensor array at a minimum of 1000 Hz to calculate required adjustments within microseconds of discharge initiation; a predictive modeling system to anticipate muzzle movement based on historical data and current conditions, enabling proactive rather than purely reactive adjustments; a calibration routine with or comprising software that guides the user through an initial setup process that establishes baseline parameters for the specific firearm, ammunition, and shooter combination where the routine collects data from multiple test firings to establish initial response patterns.

The ECRP unit 1000 is designed to integrate seamlessly with modern firearm systems through multiple connectivity options. The unit can communicate with barrel-mounted cameras, scope-mounted cameras, and other compatible accessories either via direct cable connection, wireless transmission, or other practical means. In one example, the above described connectivity enables the ECRP unit 1000 to receive real-time data about shot placement relative to the target, which the AI system uses to calculate necessary adjustments to the vent configurations. The system can also interface with mobile applications or other digital platforms to provide the user with performance metrics, configuration options, and system diagnostics. Optical System Integration can involve direct communication with electronic scopes or barrel-mounted cameras to receive target acquisition data and shot placement feedback. The system supports standard protocols used by major optics manufacturers, including picture-in-picture capability for real-time shot analysis. A mobile application interface may include companion software for mobile devices to provide a user interface for system configuration, shot analysis, and performance metrics. The interface application communicates with the ECRP unit via Bluetooth or nearfield frequencies and provides visual representations of shot patterns and adjustment recommendations. In one version, data logging and analysis functions may include integrated storage to capture performance data for post-session analysis, including: shot timing; recoil patterns; environmental conditions; vent actuation timing and positions; and shot placement accuracy.

In one mode of operation, the ECRP unit 1000 proceeds as follows: pre-firing state; initial detection; gas collection; recoil analysis; and, adaptive vent control. In the Pre-firing State, the system maintains all vents in closed position while continuously monitoring barrel position via the sensor array. The AI system establishes and records the initial line-of-sight to target as the reference position. In the step of initial detection, a firearm equipped with the ECRP unit 1000 is discharged and the onboard sensors detect the shot and the AI system begins analyzing the recoil pattern. Upon trigger activation, the system detects the firing sequence initiation through pressure and accelerometer sensors. The AI immediately calculates anticipated recoil patterns based on historical data and current conditions. In the step of gas collection, propellant gases enter the expansion chamber of the ECRP unit 1000 following the projectile. As the projectile travels through the barrel and exits through the ECRP unit, propellant gases enter the internal chamber. Pressure sensors monitor the gas pressure in real-time, providing critical data for the control algorithms. In the step of Recoil Analysis, the AI system preferably analyzes data from the sensors to determine the magnitude and direction of recoil forces and muzzle movement. Within microseconds of discharge, the gyroscopic sensors and accelerometers detect the initial movement vectors of the barrel. The AI system compares these measurements against the predicted model and calculates the optimal vent configuration to counteract the observed motion. During adaptive vent control, based on recoil analysis, the system selectively opens and closes specific vents (large vents 1100, medium vents 1200, and small vents 1300) to counteract the detected recoil forces. For example, if sensors detect that the muzzle jerks to the left during an initial shot (as illustrated in the right side of FIG. 4A), the ECRP unit 1000 calculates that by opening the left-side vents (which may include one or more of the left large vent 1100, medium vent 1200, or small vent 1300), the muzzle's recoil can be offset for a more accurate subsequent shot. Based on AI calculations, specific vents are opened precisely to direct gas flow in patterns that generate counterforce vectors. For example: If muzzle rise is detected, bottom vents may open to create downward force; if leftward drift occurs, right-side vents may open to generate rightward correction; the size of vents opened correlates to the magnitude of correction needed (larger deviations require larger vents or multiple vents working in concert). The system continuously monitors barrel position throughout the discharge sequence, making real-time adjustments to vent openings to optimize trajectory control. After each shot, the AI system compares actual performance against predicted models and updates its algorithms accordingly. This continuous learning enables progressively improved performance over time as the system becomes attuned to the specific firearm and shooter characteristics In view of the above operation, it should be apparent that the ECRP unit 1000 selects which vents to open based on the magnitude of the detected recoil, where: for larger recoil corrections, the large vents 1100 may be opened; for medium adjustments, the medium vents 1200 may be utilized; for fine-tuning or minor corrections, the small vents 1300 may be employed; and for significant adjustments, multiple vents of varying sizes may be opened in concert.

In one optional embodiment, the ECRP unit features a Near-Zero Recoil Mode. The "Near-Zero Recoil" mode may be particularly beneficial for full-automatic or select-fire weapons. In this mode, rather than focusing on precise target acquisition, the system prioritizes minimizing perceived recoil by dynamically counteracting muzzle movement during rapid fire sequences. This significantly improves controllability and can help maintain a more stable sight picture during extended firing sessions. In other words, for automatic or semi-automatic fire, the system can be configured to prioritize recoil reduction rather than target acquisition, maintaining the barrel position as close as possible to its pre-firing orientation throughout multiple discharge cycles.

In one mode or implementation, the ECRP system might be deployed on fixed-mount platforms such as a GAU-8 Avenger cannon mounted to an A-10 Warthog aircraft equipped or a machine gun (e.g., M2 machine gun) mounted on a High Mobility Multipurpose Wheeled Vehicle (HMMWV). In these examples, the identified platforms provide more predictable mounting points for recoil compensation mechanisms.

Figure 6:
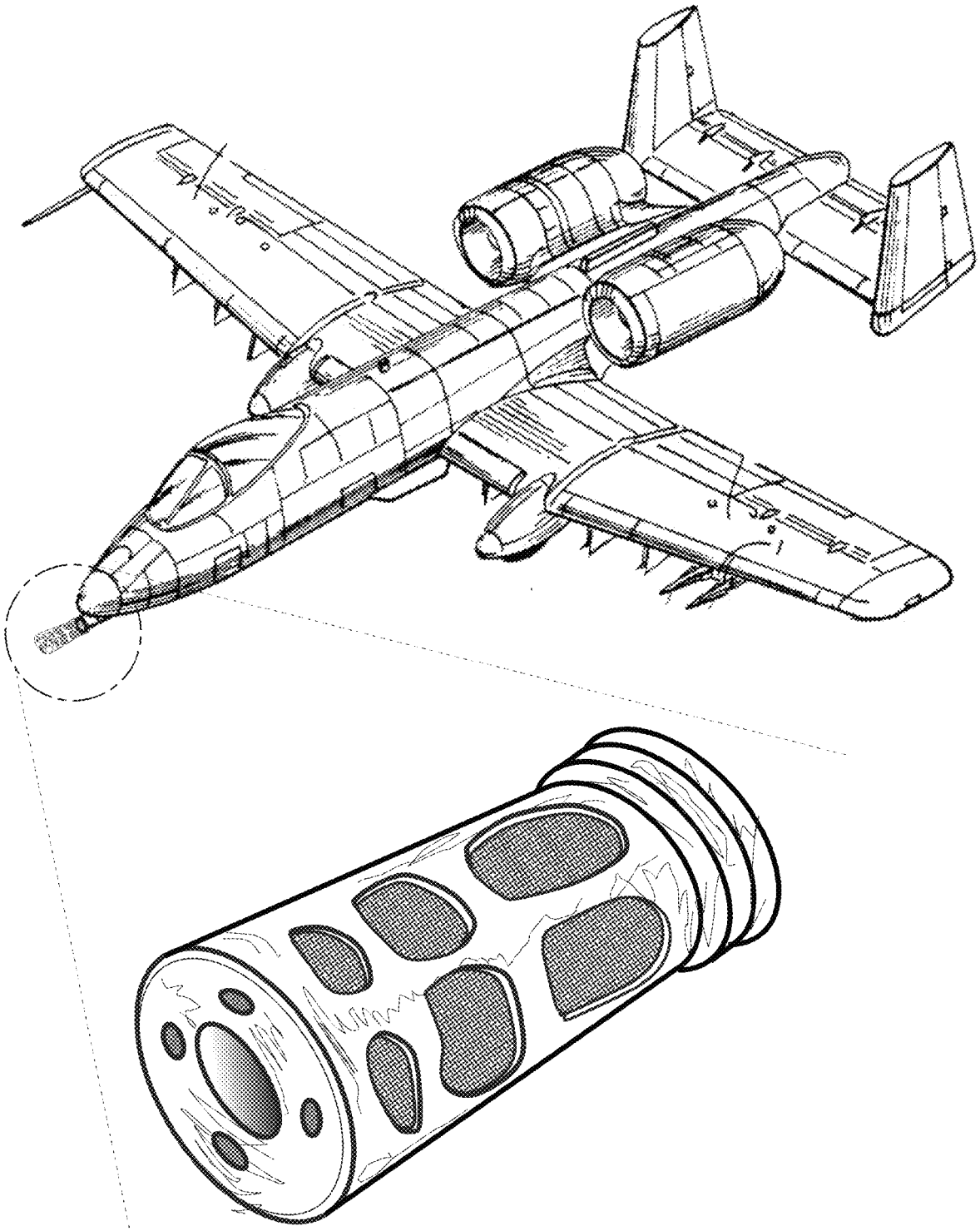

FIG. 6 shows an A-10 aircraft with a ECRP unit installed on the GAU-8 Avenger cannon mounted on the nose. When incorporated into the cannon of an A-10 Warthog aircraft, the ECRP unit interfaces with the aircraft's GAU-8 Avenger cannon system. The GAU-8 Avenger, has significant recoil force (approximately 10,000 pounds-force or 45 kN) and will benefit from the ECRP system's adaptive recoil management capabilities. In this configuration, the ECRP unit's central processing unit integrates with the aircraft's existing targeting systems while the venting mechanisms are scaled appropriately to handle the substantially larger gas volumes and pressures generated by the 30 mm cannon.

In a battlefield situations, the ECRP and targeting systems of a Warthog might work with human decision-making in several possible operational modes. In a first mode, a human operator can manually designate targets (marked as "red") and non-targets (marked as "blue") through the aircraft's targeting interface. In a second mode, the computer vision system can suggest designations that a human confirms before engagement. In a third mode, the operator can choose to accept the computer's automated designations entirely. As the aircraft performs a strafing run across a complex environment, the ECRP system would automatically adjust the recoil forces through selective vent actuation to divert projectiles that would otherwise strike entities marked as blue (non-targets). Simultaneously, the system enhances accuracy by making real-time adjustments that redirect projectiles toward red-marked targets (designated targets) that might otherwise have been missed during the pass.

In another implementation, the ECRP system is adapted for use with an M2 heavy machine gun mounted on a HMMWV. The M2, being a short recoil-operated weapon, generates significant forces during operation that the ECRP system manages through its adaptive venting capabilities. In this configuration, the ECRP unit is scaled appropriately for the M2's .50 caliber cartridge and mounts directly to the barrel while interfacing with additional sensors on the gun mount to detect both the weapon's movement and the vehicle's movement during firing.

In the M2 implementation, the operational configuration typically involves two operators. One operator manually controls the weapon's traversing motion through the standard mechanical controls, while a second operator manages the targeting decisions through an interface connected to the ECRP system. The targeting operator has three operational modes available: making targeting designations directly by marking targets and non-targets on a display, confirming computer-suggested designations before engagement, or accepting fully automated computer designations. Based on these designations and real-time sensor data, the ECRP system's control mechanism makes instantaneous adjustments to the venting patterns to ensure projectiles hit the designated targets while avoiding non-targets. This dual-operator configuration leverages both human judgment for target identification and the ECRP system's precision for recoil management.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. An electronically controlled recoil positioning (ECRP) system for a firearm, comprising:

a cylindrical body configured to attach to a muzzle of a firearm barrel, the cylindrical body having a central bore aligned with the firearm barrel;

a plurality of variably-sized vents positioned around the cylindrical body, the plurality of variably-sized vents comprising at least one large vent, at least one medium vent, and at least one small vent arranged on each of a top side, a bottom side, a left side, and a right side of the cylindrical body;

a plurality of actuators, each actuator configured to selectively open and close a corresponding one of the plurality of variably-sized vents; and a control system configured to selectively control each of the plurality of actuators based on detected recoil forces.

2. The system of claim 1, wherein the plurality of actuators comprise at least one of: axially sliding covers, hinged covers, or circumferentially sliding covers.

3. The system of claim 2, wherein the control system comprises a sensor array comprising at least one of: gyroscopic sensors, accelerometers, pressure sensors, or thermal sensors; and a processor configured to analyze data from the sensor array to determine which of the plurality of variably-sized vents to open or close.

4. The system of claim 3, wherein the processor executes an artificial intelligence algorithm that develops an individualized shooter profile based on historical shooting patterns.

5. The system of claim 4, further comprising a communication module configured to interface with at least one of: a barrel-mounted camera, a scope-mounted camera, a mobile device, or an electronic trigger system.

6. The system of claim 1, wherein the control system is configured to operate in a near-zero recoil mode that prioritizes minimizing muzzle movement during rapid fire sequences.

7. An artificial intelligence-driven recoil control system for a firearm, comprising:

a muzzle-mounted unit comprising a plurality of independently controllable vents;

a sensor array configured to detect movement of the firearm during discharge;

processor executing an artificial intelligence subsystem configured to:

(a) analyze data from the sensor array to determine magnitude and direction of recoil forces;

(b) develop a shooter profile based on historical shooting patterns;

(c) predict recoil patterns based on the shooter profile and current conditions; and (d) determine which of the plurality of independently controllable vents to open and close to counteract the recoil forces; and a plurality of actuators configured to selectively open and close the plurality of independently controllable vents based on determinations from the artificial intelligence subsystem.

8. The system of claim 7, wherein the sensor array comprises at least one gyroscopic sensor configured to detect angular movement, at least one accelerometer configured to measure linear forces, and at least one pressure sensor configured to monitor gas pressure during discharge.

9. The system of claim 8, wherein the artificial intelligence subsystem comprises a machine learning algorithm configured to analyze shot placement data, a real-time analysis engine configured to process sensor data, and a predictive modeling system configured to anticipate muzzle movement based on historical data and current conditions.

10. The system of claim 8, further comprising an optical system integration module configured to communicate with at least one of a scope or a barrel-mounted camera to receive shot placement data; and wherein the artificial intelligence subsystem is further configured to correlate the shot placement data with recoil patterns detected by the sensor array.

11. The system of claim 10, wherein the artificial intelligence subsystem includes a selectable near-zero recoil mode that prioritizes minimizing perceived recoil during rapid fire sequences over precise target acquisition.

12. The system of claim 7, wherein the plurality of independently controllable vents are arranged symmetrically around the muzzle-mounted unit with at least three different vent sizes on each of a top side, a bottom side, a left side, and a right side of the muzzle-mounted unit.

13. A method for dynamically controlling recoil in a firearm, comprising:

1. detecting, via a sensor array, discharge of the firearm;
2. analyzing, via a processor, movement data from the sensor array to determine recoil characteristics;
3. selecting a recoil compensation mode from at least a precision targeting mode and a near-zero recoil mode, wherein the near-zero recoil mode prioritizes minimizing muzzle movement during rapid fire sequences;
4. determining, based on the selected recoil compensation mode and the determined recoil characteristics, which of a plurality of variable-sized vents on a muzzle-mounted unit to actuate; and
5. selectively opening and closing one or more of the plurality of variable-sized vents to counteract detected recoil forces according to the selected recoil compensation mode.

14. The method of claim 13, wherein analyzing movement data comprises detecting initial vectors of barrel movement using gyroscopic sensors and accelerometers, comparing the detected vectors against a predicted model, and calculating an optimal vent configuration to counteract the detected movement.

15. The method of claim 14, further comprising receiving shot placement data from at least one of a barrel-mounted camera or a scope-mounted camera; and updating the shooter profile based on the shot placement data.

16. The method of claim 15, wherein the near-zero recoil mode comprises detecting a rapid fire sequence; and continuously adjusting vent openings to minimize muzzle movement throughout the rapid fire sequence.

17. The method of claim 16, further comprising after each discharge, comparing actual performance against predicted models; and updating control algorithms based on the comparison.

18. The method of claim 13, wherein determining which of the plurality of variable-sized vents to actuate comprises selecting larger vents for larger recoil corrections, selecting medium vents for medium adjustments, selecting smaller vents for fine-tuning or minor corrections, and selecting multiple vents of varying sizes for significant adjustments.

* * * * *